US005337520A

United States Patent [19]

Uribe

[11] Patent Number: 5,337,520

[45] Date of Patent: Aug. 16, 1994

[54] SAFETY DEVICE FOR OVERHEAD DOORS

[76] Inventor: Aramando B. Uribe, 11744 Hatteras St., North Hollywood, Calif. 91607

[21] Appl. No.: 871,276

[22] Filed: Apr. 20, 1992

[51] Int. Cl.[5] ..... E05F 15/00

[52] U.S. Cl. ..... 49/197; 49/203

[58] Field of Search ..... 49/197, 199, 200, 203, 49/204; 160/193

[56] References Cited

U.S. PATENT DOCUMENTS

| | | | |
|---|---|---|---|
| 1,280,920 | 10/1918 | Wexler . | |
| 2,597,824 | 5/1952 | Schreiber . | |
| 2,923,981 | 2/1960 | Beck . | |
| 3,616,575 | 11/1971 | Harris | 49/200 |
| 4,019,442 | 4/1977 | Lee et al. | 49/200 X |
| 4,520,591 | 6/1985 | Calvagno . | |
| 4,956,938 | 9/1990 | DeMent . | |

FOREIGN PATENT DOCUMENTS

| | | | |
|---|---|---|---|
| 2609863 | 3/1977 | Fed. Rep. of Germany | 49/204 |
| 2623440 | 12/1977 | Fed. Rep. of Germany | 49/200 |
| 1521012 | 4/1968 | France | 49/203 |
| 1528753 | 6/1968 | France | 9/203 |

*Primary Examiner*—Peter M. Cuomo
*Assistant Examiner*—Jerry Redman
*Attorney, Agent, or Firm*—Spensley Horn Jubas & Lubitz

[57] ABSTRACT

In conjunction with a conventional frame-enclosed overhead door system, a safety device for preventing the door from falling in the event that the upper rollers of the door break away from the door or become disengaged from their tracks, the invention comprises a pair of supports each having a first and second end. The first end of each support is pivotally secured to opposite side edges of the door substantially at the midpoint between the rollers on each side edge of the door. The second end of each support is pivotally secured, opposite each other, to an area of the garage adjacent to the intersection where the vertical and horizontal tracks meet. The supports are substantially equal in length and parallel to each other. In the event that the upper rollers of the door break away from the door, the supports will prevent further significant movement of the door.

14 Claims, 3 Drawing Sheets

SAFETY DEVICE FOR OVERHEAD DOORS

FIELD OF THE INVENTION

The present invention relates to safety devices for overhead doors. More particularly, this invention relates to a safety device for frame-enclosed overhead garage doors for preventing the door from falling if the rollers supporting the door fail.

BACKGROUND OF THE INVENTION

A typical and common frame-enclosed overhead garage door assembly comprises a pair of vertical tracks wherein each vertical track is mounted on opposite sides of the garage door opening, extending up the sides of the opening. These tracks are parallel to each other and sometimes are curved perpendicularly at their uppermost points to extend back into the garage.

Other times, instead of using curved vertical tracks, a pair of parallel horizontal tracks which also extend back into the garage are used. Each horizontal track corresponds to one of the vertical tracks. The horizontal tracks are substantially perpendicular to and intersect the uppermost point of their respective vertical tracks.

Rollers or wheels are mounted onto the side edges of the door, typically adjacent to the corners of the door, and inserted into the tracks enabling the door to move within the tracks.

When the door is in its fully opened position, it extends back over the opening parallel to the floor. As the door is being closed, it begins to develop a downward component of force due to its weight.

To prevent the door from forcefully and rapidly closing shut under its own weight while it is in the partially open position, a counterweight is ordinarily provided in which at least one cable is connected at one end to the door and at its opposite end to a spring which is attached to the building frame or track.

The force of the spring is designed to balance approximately the weight of the door to make it easier to raise the door from its closed position and also reduce the possibility of accident should the door handle be released before it is fully open or fully closed.

Overhead garage doors are commonly found in industrial facilities and in many home and apartment garages. These doors typically have a width greater than the width of an automobile and a height greater than six feet. These doors usually have a thickness greater than approximately one inch depending on their design and type of construction. The design and construction of these overhead doors often vary. For example, some doors are completely wooden and some others are made of sheet metal mounted over a wooden or angle iron frame.

The weight of these doors can be considerable depending on their dimensions as well as the material used to make them. For example, wooden doors usually weigh substantially more than the sheet metal-type doors.

Nevertheless, overhead doors are capable of causing serious damage and injury if they are rapidly closed.

Overhead doors become even more dangerous if they either break away from their supporting upper rollers or if their rollers disengage from their respective horizontal tracks, while the door is completely or partially open, and fall. Accidents of this nature are common, and the damage and/or injury caused by these accidents are usually significant.

The only overhead garage door safety devices that presently exist are those directed towards only preventing these doors from rapidly closing downward under its own weight with great force.

The counterweight system described above, is one example of such a safety device.

Another kind of safety device for preventing overhead doors from slamming closed is disclosed in Calvagno, U.S. Pat. No. 4,520,591. The device of Calvagno is directed towards a safety lock assembly with a garage door to prevent the door from closing uncontrollably in the event the counterweight system, discussed above, fails. This device is comprised of a pivoted arm biased into a position blocking the movement of the door. The counterweight system is attached to the pivoted arm to overcome the bias. In the event of a failure in the weight supporting members, the built-in bias will move the arm into its position where further significant movement of the door is prevented.

These systems and devices, however, do not prevent overhead doors from falling and causing serious injury or damage should the supporting upper rollers fail by either breaking away from the door or by becoming disengaged from the tracks. Presently, no such safety device exists which overcomes this problem.

SUMMARY OF THE INVENTION

To overcome the aforementioned problems, the present invention provides an overhead door safety device for preventing the door from falling, if the upper supporting rollers fail or break.

In its broadest sense, the safety device of this invention comprises a pair of overhead door support means which are each pivotally secured at one end to opposite side edges of the door approximately at the midpoint between the rollers. The other end of each support means is pivotally secured to a portion of the garage adjacent to where each pair of vertical and horizontal tracks intersect each other. The support means are made of a material sufficient to support the entire weight of the door. Further, the support means are substantially equal in length and parallel to each other.

Other objects, features and advantages of the invention will become apparent from a consideration of the following detailed description and from the accompanying drawings.

DETAILED DESCRIPTION OF THE INVENTION

Figure 1:
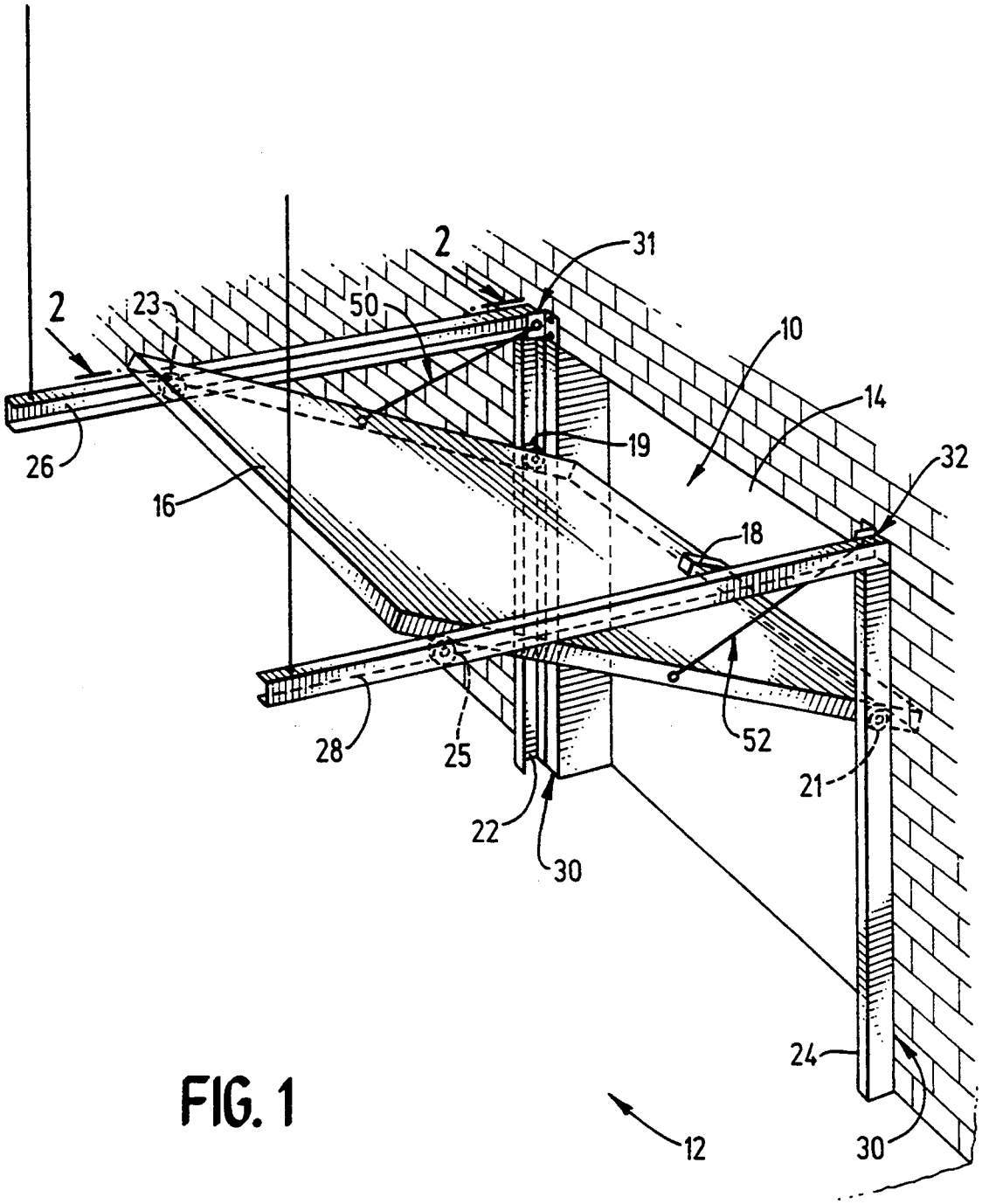
FIG. 1 is a perspective view of the garage door assembly with the safety device of the present invention.

Referring more particularly to the drawings, FIG. 1 shows a perspective view of the frame-enclosed overhead garage door system 10 of the present invention. This system 10 includes a garage 12 with an opening 14 for a partially opened garage door 16, having a handle 18.

The system 10 has a pair of vertical tracks 22 and 24 which are located on opposite sides of the door opening 14, extending up along the jambs 30. The vertical tracks 22 and 24 are parallel to each other.

Also shown in FIG. 1 is a pair of horizontal tracks 26 and 28 which are parallel to each other. Horizontal tracks 26 and 28 are located adjacent and perpendicular to the upper portions of the vertical tracks 22 and 24, respectively. Further, horizontal tracks 26 and 28 intersect vertical tracks 22 and 24 at points 31 and 32, respectively and extend back into the garage 12 above the opening 14.

The garage door 16 has a plurality of rollers or wheels mounted to its side edges. It is preferable that the door has a pair of lower rollers 19 and 21 and a pair of upper rollers 23 and 25, as shown in FIG. 1.

As shown in FIG. 1, the lower rollers 19 and 21 ride within tracks 22 and 24, respectively. The lower rollers 19 and 21 are located opposite each other on a common axis adjacent to the lower linear edge of the door 16. It will be understood that a substantial portion of the door may project forwardly from the axis of the lower rollers.

Figure 2:
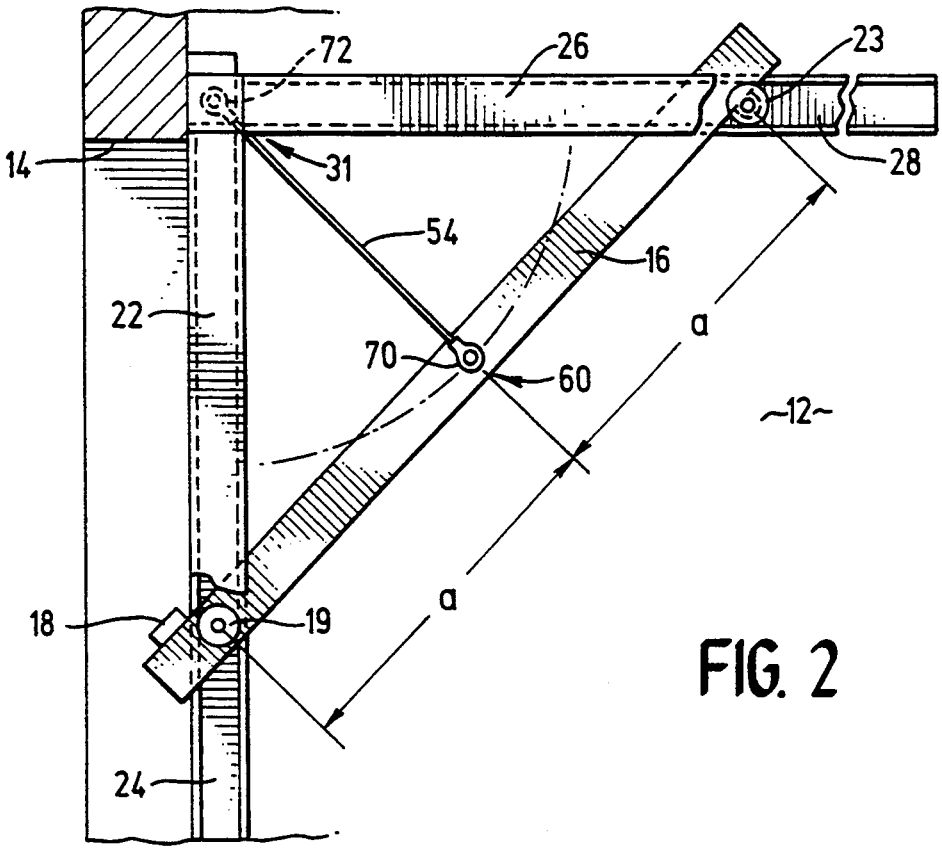
FIG. 2 is a side elevation view of one embodiment of the safety device of the present invention as seen along line 2—2 in FIG. 1, wherein the support means comprise cables.

The upper rollers 23 and 25 ride within the tracks 26 and 28, respectively. The upper rollers 23 and 25 are located opposite each other on a common axis adjacent and parallel to the upper linear edge of the door 16 (see FIG. 1); the rollers 23 and 25, as best seen in FIG. 2, are set back to provide clearance for the intersection of the tracks at points 31 and 32.

The lower rollers 19 and 21 are located at a distance from the lower linear edge of the door 16 equal to the distance in which the upper rollers 23 and 25 are located from the upper linear edge.

The rollers 19, 21, 23, 25 ride within tracks 22, 24, 26, 28, respectively, for guiding the door 16 as the door moves within its open and closed positions, as well known in the art. For example, when the door 16 is raised and opened by lifting the handle 18, the rollers 19, 21 and 23, 25 are guided along their respective tracks 22, 24, and 26, 28 to bring the door 16 around to a position over the opening 14 and extending back into the garage 12. When fully opened, the door 16 is substantially parallel to the floor of the garage 12.

The rollers 23 and 25 have been known to fail, thus causing the door 16 to unexpectedly fall, sometimes causing severe injury to both persons and property.

For example, these doors 16, especially those which are used in industrial facilities, are usually very heavy due to their relatively large sizes and have been known to break away from their supporting upper rollers and fall.

Other times, the weight of the door 16 causes the rollers 23 and 25 to dislodge from their tracks 26 and 28, thus causing the door to fall.

In order to prevent such eventualities, Applicant has invented an overhead door safety device comprising a first support means 50 and a second support means 52, each having a length substantially equal to each other and whose purpose is to support the entire weight of the door 16 should the supporting rollers 23 and 25 fail.

As shown in FIG. 1, the support means 50 and 52 each are pivotally secured to opposite sides of the door 16 at the midpoint 60 between rollers 19, 23 and 21, 25, respectively. The support means 50 and 52, also have a second end which is pivotally secured to a portion of the inside of the garage 12 substantially adjacent to the point where the vertical tracks 22 and 24 intersect 31 and 32 with the horizontal tracks 26 and 28, respectively.

The support means 50 and 52 should be accurately placed in order for them to maintain a constant tension on the door. The support means 50 and 52 of the present invention are opposite and parallel to each other and are made of a material sufficient to support the entire weight of the door 16.

Further, the support means are sufficiently thin in order to fit within an existing gap located between said door 16 and said vertical tracks 22 and 24. The overhead door support means may include cables, bars, ropes, chains, or any other objects capable of supporting the entire weight of the door and thin enough to fit within the existing gap between the sides of door and the vertical tracks 22 and 24.

In accordance with one embodiment of the present invention, said support means 50, 52 comprise cables.

FIG. 2 shows a side view of the present invention taken along line 2—2, wherein the first and second support means comprise cables 54. Even though FIG. 2 shows only one side of the safety device assembly of the present invention, it is to be understood and recognized, by referring to FIG. 1, that a symmetrically identical safety device assembly is present on the opposite side.

As shown in FIG. 2, the first end of the first cable 54 preferably is pivotally secured to an annular ring 70 which is securely bolted to the side edge of the door at the midpoint between the rollers 19 and 23.

The second end of the cable 54 is pivotally secured to an annular ring 72 which is securely bolted to an area inside the garage at or adjacent to the intersection 31 where vertical track 22 and horizontal track 26 meet.

On the opposite side (not shown, but may be inferred viewing FIGS. 1 and 2) the first end of the first cable is also pivotally secured to an annular ring which is bolted to the other side edge of the door at its midpoint. The second end of the cable is pivotally secured to an annular ring which is securely bolted to an area inside the garage at or adjacent to the intersection 32 where vertical track 24 and horizontal track 28 meet (see FIGS. 1 and 2).

Preferably, the cables 54 are made of metal such as steel. In addition, both cables should also be equal in length, maintain a constant tension and have a strength sufficient to support the entire weight of the door. The cables 54 should also be sufficiently thin to fit within an existing gap located between the door 16 and the vertical tracks 22 and 24.

The annular rings 70 and 72 are made of a solid and durable metal material such as steel.

Figure 3:
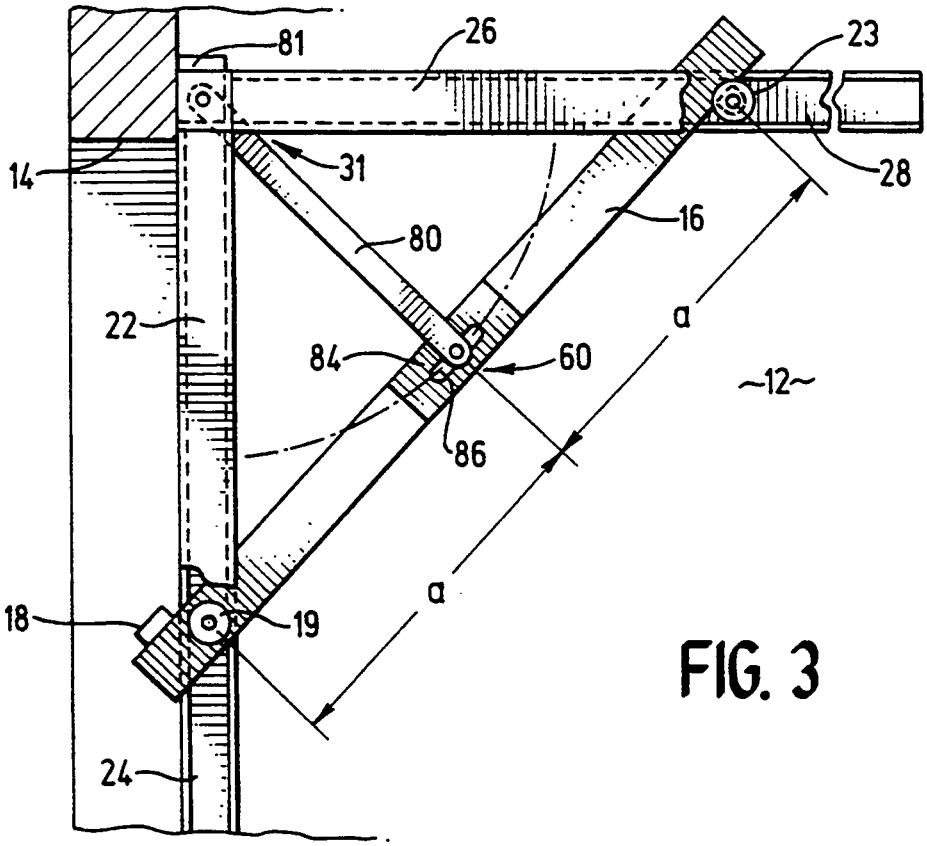
FIG. 3 is a side elevation view of a second embodiment of the safety device of the present invention, wherein the support means comprise bars.

In a second embodiment of the present invention, a pair of bars 80 may be used instead of the cables to support the door 16 if the rollers 23 and 25 fail or are dislodged from their tracks 26 and 28 (see FIGS. 1 and 3).

FIG. 3 is a side view of one side of the present invention taken along line 2—2 of FIG. 1. Even though FIG. 3 shows only one side of the alternate embodiment, it is to be understood and recognized, by referring to FIG. 1, that a symmetrically identical safety device assembly is present on the opposite side.

In accordance with the second embodiment of the present invention, the first end of the first bar 80 is pivotally secured to the side edge of the door 16 at the midpoint 60 between the rollers 19 and 23, at or near the center of gravity of the door.

The bar 80 may also be pivotally secured to a plate 84 having a slot 86 which is located and mounted on the side edge of the door at the midpoint 60 between rollers 19 and 23. By using this plate 84 with the slot 86, the bar 80 does not have to be precisely positioned at the midpoint 60.

The bar 80 has a second end, opposite to the first end, which is the secured to an area inside the garage at or adjacent to the intersection 31 where vertical track 22 and horizontal track 26 meet.

Figure 4:
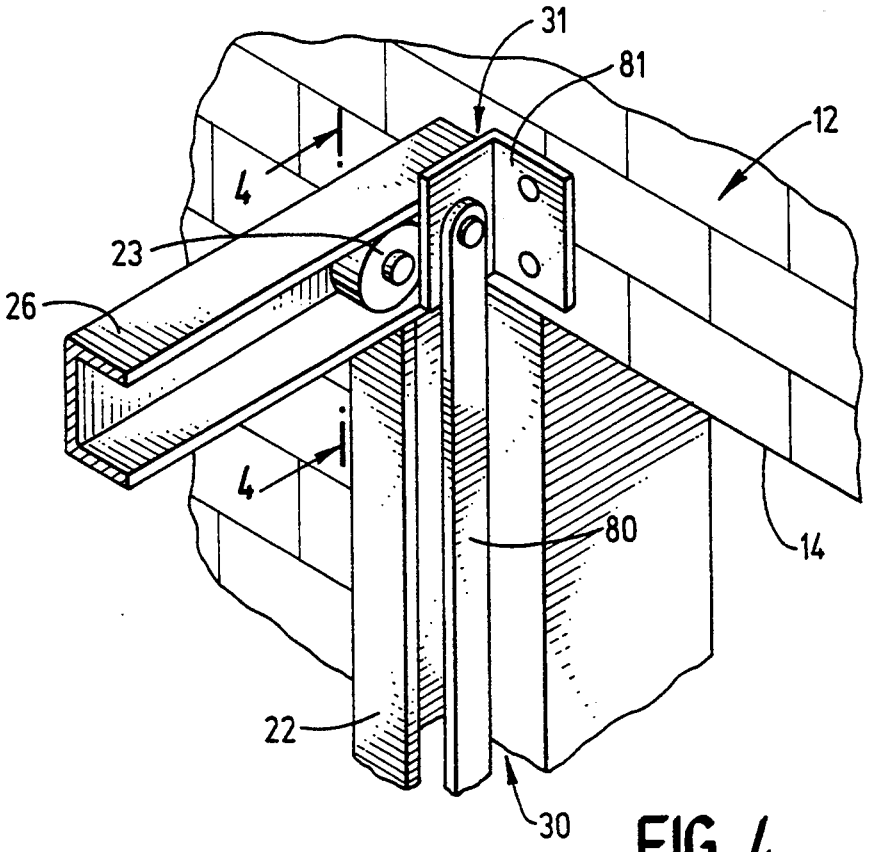
FIG. 4 is a perspective view of the area where one horizontal and vertical track intersect.
Figure 5:
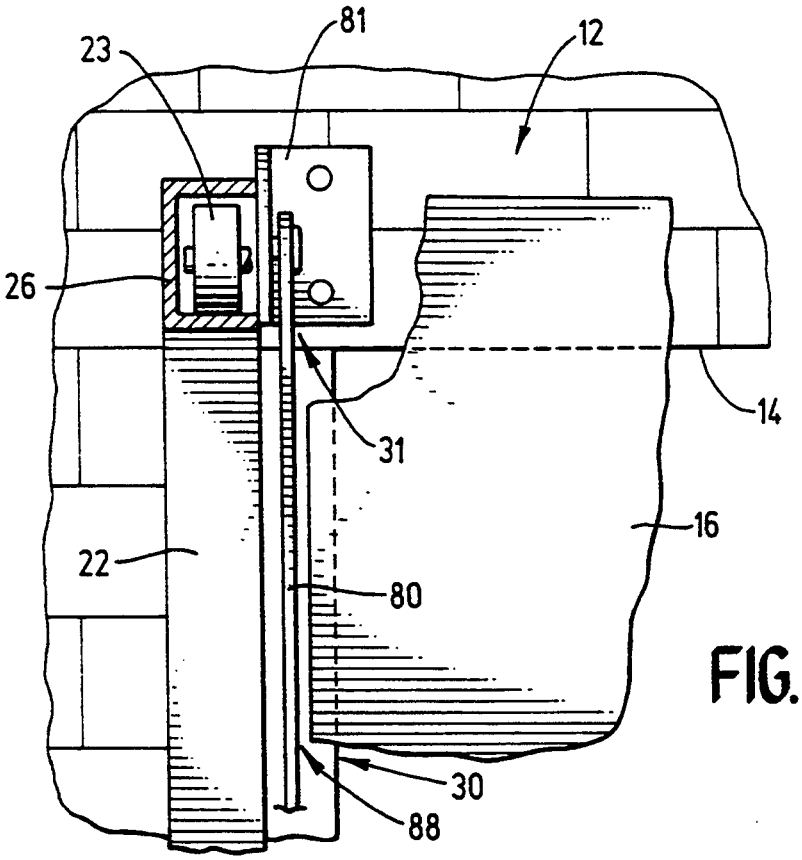
FIG. 5 is a vertical sectional view of the device of the present invention taken along line 4—4 of FIG. 4.

As shown in FIGS. 3, 4 and 5, the bar 80 is securely and pivotally bolted to one side of an angle plate 81 located at or near intersection 31. Another side of the angle plate 81 is bolted to the top of the garage door opening 12 to the inner wall of the garage. It is preferable that the angle plate be made of a solid and durable metal material, for example, steel or iron.

On the opposite side (not shown, but may be inferred by FIGS. 1 and 3)) the first end of the second bar is also pivotally secured to the other side edge of the door at the midpoint between rollers 21 and 25. The second bar also may be pivotally secured to a plate 84 having a slot 86 which is located approximately at the midpoint between the rollers 21 and 25.

The second end of the second bar is secured to an area inside the garage at or adjacent to the intersection 32 where vertical track 24 and horizontal track 28 meet.

The bars should be equal in length, have a constant tension and be made of a material having a strength sufficient to support the weight of the entire garage door. It is preferable that the bars be made of solid steel and sufficiently thin to fit within the existing gap 88 between the side edges of the door and the vertical tracks 22 and 24, as shown in FIG. 5.

Preferably, cables should be used for smaller, lighter doors while bars should be used for larger, heavier doors.

The safety device of the present invention, therefore, secures a garage door against significant movement and prevents overhead doors from falling in the event that the rollers 23 and 25 fail. In addition, the safety device of the present invention allows the overhead door to maintain normal operation even when the rollers 23 and 25 are taken off the door 16 or removed from their tracks 26 and 28.

The safety device of the present invention as set forth in the above embodiments is also both easy and inexpensive to install and can be retrofit to existing garage door systems. The safety device of the present invention allows one to remove and replace the rollers from their tracks if they become damaged, without having the door crash down.

It is to be understood that the foregoing description of the accompanying drawings shall relate to preferred and illustrated embodiments of the invention. Various modifications may be important without departing from the sphere and the scope of the invention. For example, the present invention may be used for overhead doors which are electrically powered to open and close. The device of this invention may also be fitted for articulated overhead doors made up of straight panel sections supported on one side by rollers, as is understood in the art.

Accordingly, the present invention not limited to that precisely shown and described in the claims which follows.

I claim:

1. For use with a garage having a floor, a garage door opening and a frame-enclosed overhead door system bordering the garage door opening, said door system being defined by jambs, a first vertical track having a first end and a second end, a second vertical track parallel to said first vertical track and having a first end and a second end, wherein said first and second vertical tracks are located on opposite sides of said door opening extending up along the jambs, and wherein the second ends of said first and second vertical tracks are disposed adjacent to said floor, a first horizontal track and a second horizontal track parallel to said first horizontal track, each said horizontal track intersecting and being located adjacent and perpendicular to a respective one of the first end of said first and second vertical tracks and extending back into said garage above the door opening, a garage door having a pair of parallel side edges, a pair of spaced apart rollers mounted on each side edge of said door for riding within said tracks permitting movement of said door between a vertically extending position closing said opening and a fully open position above and back from said opening substantially parallel to the floor of said garage, said door being movable between said positions, each said side edge having a midpoint equispaced from said pair of rollers at that side edge, and said rollers in said tracks guiding said door as said door moves between its open and closed positions, a safety device for immediately stopping and preventing the door from falling and closing if the rollers fail, said safety device comprising:

a first support means having a first end pivotally secured to a first side edge of said door substantially at the midpoint between the rollers mounted on said first side edge;

said first support means having a second end pivotally secured to a portion of the inside of the garage adjacent to said intersection of said first horizontal track and said first vertical track;

a second support means having a first end pivotally secured to a second side edge of said door substantially at the midpoint between the rollers mounted on said second side edge;

said second support means having a second end pivotally secured to a portion of the inside of the garage adjacent to said intersection of said second horizontal track and said second vertical track;

said first and second support means having a tensile strength sufficient to support the entire weight of said door;

each of said first and second support means comprising a first and second bar, respectively, each said bar having first and a second ends defining the first and second ends of the respective support means; and said first end of said first and second bars each being secured to a plate having a slot, said plates being securely mounted, opposite each other, to the side edges of said door substantially at each said midpoint on each said side edge of the door.

2. The safety device according to claim 1 wherein said support means are made of a solid and durable material.

3. The safety device according to claim 2 wherein said support means are made of metal.

4. The safety device according to claim 1 wherein said second end of said first and second bars are each bolted to angle plates located and bolted to an area adjacent to said intersections of said vertical and horizontal tracks.

5. The safety device according to claim 1 wherein said first and second bars are made of metal.

6. The safety device according to claim 5 wherein said first and second bars are made of steel.

7. The safety device according to claim 1 wherein said first and second bars are sufficiently thin to fit within an existing gap between said door and said vertical tracks.

8. For use with a garage having a floor, a garage door opening and a frame-enclosed overhead door system bordering the garage door opening, said door system being defined by jambs, a first vertical track having a first end and a second end, a second vertical track parallel to said first vertical track and having a first end and a second end, wherein said first and second vertical tracks are located on opposite sides of said door opening extending up along the jambs, and wherein the second ends of said first and second vertical tracks are disposed adjacent to said floor, a first horizontal track and a second horizontal track parallel to said first horizontal track, each said horizontal track intersecting and being located adjacent and perpendicular to a respective one of the first end of said first and second vertical tracks and extending back into said garage above the door opening, a garage door having a pair of parallel side edges, a pair of spaced apart rollers mounted on each side edge of said door for riding within said tracks permitting movement of said door between a vertically extending position closing said opening and a fully open position above and back from said opening substantially parallel to the floor of said garage, said door being movable between said positions, each said side edge having a midpoint equispaced from said pair of rollers at that side edge, and said rollers in said tracks guiding said door as said door moves between its open and closed positions, a safety device for immediately stopping and preventing the door from falling and closing if the rollers fail, said safety device comprising:

a first support cable having a first end secured to a first side edge of said door substantially at the midpoint of said first side edge;

said first support cable having a second end secured to a portion of the inside of the garage substantially at said intersection of said first horizontal track and said first vertical track;

a second support cable having a first end secured to a second side edge of said door substantially at the midpoint of said second side edge;

said second support cable having a second end secured to a portion of the inside of the garage substantially at sid intersection of said second horizontal track and said second vertical track; and said first and second support cables having a tensile strength sufficient to support the entire weight of said door in the event of a failure of the rollers.

9. The safety device according to claim 8 wherein said first end of said first and second cables are each secured to an annular ring wherein said annular rings are securely coupled, opposite each other, to the side edges of said door, substantially at each said midpoint on each said side edge of the door.

10. The safety device according to claim 9 wherein said annular rings are made of metal.

11. The safety device according to claim 8 wherein said second end of said first and second cables are each secured to an annular ring wherein said annular rings are securely coupled, opposite each other, to an area adjacent to said intersections of said horizontal and said vertical tracks.

12. The safety device according to claim 11 wherein said annular rings are made of metal.

13. The safety device according to claim 8 wherein the first and second support means comprise a first and second cable, wherein said first and second cable are made of metal.

14. The safety device according to claim 8 wherein said first and second cables are sufficiently thin to fit within an existing gap between the sides of said door and said vertical tracks.

* * * * *